US011326831B2

(12) United States Patent
Lindel et al.

(10) Patent No.: US 11,326,831 B2
(45) Date of Patent: May 10, 2022

(54) HOUSEHOLD APPLIANCE APPARATUS WITH A FLOW SEPARATING UNIT AND HOUSEHOLD APPLIANCE

(71) Applicant: BSH HAUSGERAETE GMBH, Munich (DE)

(72) Inventors: Andreas Lindel, Heidenheim (DE); Herbert Weibl, Bachhagel (DE); Michael Krapp, Nattheim (DE)

(73) Assignee: BSH Hausgeraete GmbH, Munich (DE)

( * ) Notice: Subject to any disclaimer, the term of this patent is extended or adjusted under 35 U.S.C. 154(b) by 255 days.

(21) Appl. No.: 16/249,966

(22) Filed: Jan. 17, 2019

(65) Prior Publication Data

US 2019/0226754 A1 Jul. 25, 2019

(30) Foreign Application Priority Data

Jan. 24, 2018 (DE) ..... 10 2018 201 098.6

(51) Int. Cl.
*F25D 23/10* (2006.01)
*F25D 11/02* (2006.01)

(52) U.S. Cl.
CPC ..... *F25D 23/10* (2013.01); *F25D 11/02* (2013.01); *F25D 2323/0021* (2013.01); *F25D 2323/00264* (2013.01)

(58) Field of Classification Search
CPC ..... F25D 23/08; F25D 23/082; F25D 23/087; F25D 23/10; F25D 23/023; F25D 23/025; F25D 2323/0021; F25D 2323/0022; F25D 2323/0023; F25D 2323/0026; F25D 2323/00261; F25D 2323/00263; F25D 2323/0027; F25D 2323/00271; F25D 2323/00273; F25D 2323/00264; F25D 2323/00266

See application file for complete search history.

(56) References Cited

U.S. PATENT DOCUMENTS 2,672,029 A * 3/1954 Saunders ..... F25D 11/02 62/297
2,675,901 A * 4/1954 Childers ..... G07F 9/105 194/350
2,758,741 A * 8/1956 Saunders ..... F25D 23/085 220/592.07
3,055,723 A * 9/1962 Hildebrand, Sr. .... A47F 5/0087 312/200

(Continued)

FOREIGN PATENT DOCUMENTS

EP 2522937 A2 * 11/2012 ..... F25D 21/14
JP 2002119082 A 4/2002

(Continued)

*Primary Examiner* — Miguel A Diaz
(74) *Attorney, Agent, or Firm* — Laurence A. Greenberg; Werner H. Stemer; Ralph E. Locher

(57) ABSTRACT

A household appliance apparatus, in particular a household refrigeration appliance apparatus, has at least one flow separating unit which is provided for separating at least two airflows. In order to provide improved properties with regard to a ventilation of heat-generating freestanding household appliance components, the flow separating unit is provided for mounting on an outer wall of a freestanding household appliance.

12 Claims, 3 Drawing Sheets

(56) References Cited

U.S. PATENT DOCUMENTS 3,759,059 A * 9/1973 Kenyon ..... F25D 21/14 62/246
3,779,624 A * 12/1973 Werderitsch ..... A47B 95/043 312/278
4,290,660 A * 9/1981 Brezosky ..... A47B 95/002 312/249.8
5,181,341 A * 1/1993 Keys ..... E01C 11/10 404/49
5,806,942 A * 9/1998 Jenkins, Jr ..... F25D 23/028 312/204
8,555,664 B2 * 10/2013 Ihle ..... F25D 21/002 62/183
2005/0115272 A1 * 6/2005 Lim ..... F25D 23/10 62/507
2005/0120738 A1 * 6/2005 Chun ..... F25D 23/003 62/455
2006/0101843 A1 * 5/2006 Manole ..... F25D 23/003 62/426
2006/0101844 A1 * 5/2006 Manole ..... F25D 23/003 62/441
2008/0223063 A1 * 9/2008 Jeong ..... F25D 21/14 62/291
2010/0018230 A1 * 1/2010 Ihle ..... F25D 21/002 62/234
2010/0242525 A1 * 9/2010 Park ..... F25D 23/003 62/440
2011/0030410 A1 * 2/2011 Ciyanoglu ..... F25D 23/10 62/331
2013/0019629 A1 * 1/2013 Kim ..... F25D 23/003 62/408
2013/0269262 A1 * 10/2013 Siegel ..... B60R 13/08 49/492.1
2020/0031404 A1 * 1/2020 Siegel ..... B62D 25/18
2020/0141629 A1 * 5/2020 Seo ..... F25D 23/003
2021/0102419 A1 * 4/2021 Braden ..... F24C 15/08
2021/0278123 A1 * 9/2021 Kim ..... F25D 17/08

FOREIGN PATENT DOCUMENTS

JP 2005201530 A * 7/2005
JP 2007024348 A * 2/2007
WO WO-2006058819 A1 * 6/2006 ..... F25D 23/003

* cited by examiner

HOUSEHOLD APPLIANCE APPARATUS WITH A FLOW SEPARATING UNIT AND HOUSEHOLD APPLIANCE

CROSS-REFERENCE TO RELATED APPLICATION

This application claims the priority, under 35 U.S.C. § 119, of German application DE 10 2018 201 098.6, filed Jan. 24, 2018; the prior application is herewith incorporated by reference in its entirety.

BACKGROUND OF THE INVENTION

Field of the Invention

The invention relates to a household appliance apparatus.

A household appliance apparatus which has a flow separating unit for separating at least two airflows is already known from the prior art. In this connection, for example, published Japanese patent application JP 02-119082 A discloses a hob apparatus with a fan impeller for cooling electrical circuits of the hob apparatus and a trough in which the hob apparatus is arranged, wherein the trough has guide elements for guiding and separating a plurality of airflows.

BRIEF SUMMARY OF THE INVENTION

The object of the invention, in particular, is to provide a generic household appliance apparatus with improved properties with regard to a ventilation of heat-generating household appliance components.

The invention is based on a household appliance apparatus, in particular a household refrigeration appliance apparatus, with at least one flow separating unit which is provided for separating at least two airflows.

It is proposed that the flow separating unit is provided for mounting on an outer wall of a freestanding household appliance.

In particular, a first airflow which is produced by air being drawn in on a rear face of the freestanding household appliance is able to be separated from a third airflow which is produced by the expelled air flowing on a lower face of the freestanding household appliance in the direction of the rear face of the freestanding household appliance. The expelled air flows as a second airflow at least substantially on the lower face of the freestanding household appliance in the direction of a front face of the freestanding household appliance. The third airflow flows as a portion of the expelled air in the direction of the rear face of the freestanding household appliance, the third airflow flowing back on itself and being diverted by the flow separating unit toward the front face of the freestanding household appliance.

A "household appliance apparatus", in particular a "household refrigeration appliance apparatus" is intended to be understood, in particular, as at least one part, in particular a subassembly, of a freestanding household appliance, in particular of a household refrigeration appliance. In particular, the household appliance apparatus may also encompass the entire freestanding household appliance, in particular the entire household refrigeration appliance. For example, a freestanding household appliance containing the household appliance apparatus, in particular a household refrigeration appliance, could be a chest freezer and advantageously a refrigerator and/or upright freezer, wherein a combined fridge/freezer is also conceivable. Particularly advantageously, a freestanding household appliance which is configured as a household refrigeration appliance is provided to refrigerate and/or freeze, in at least one operating state, refrigerated goods and/or frozen goods, in particular food, such as for example beverages, meat, fish, milk and/or dairy products, in particular in order to provide a longer shelf life of the refrigerated goods and/or frozen goods. Alternatively, the freestanding household appliance may be configured as a cooking appliance, in particular an oven, as a dishwasher, as a laundry treatment appliance, in particular a washing machine and/or a tumble dryer, and/or as a further appliance which appears meaningful to the person skilled in the art.

A "freestanding household appliance" is intended to be understood, in particular, as a household appliance which is configured as a large appliance and/or as a furniture-type household appliance, for example as a fridge-freezer and which in at least one operating state is positioned on the supporting surface, for example on a floor or on a bottom surface of a kitchen unit and is at least partially in contact therewith, preferably by at least one supporting unit.

A "front face" is intended to be understood, in particular, as a freely accessible side of an outer wall, in particular of the freestanding household appliance, at least substantially facing an operator in an installed position and in at least one operating state, in particular not covered by a region of a kitchen unit or a room wall or a further surface defining an alcove, wherein the side preferably has a door, in particular a refrigerator door. In this connection, an "alcove" is intended to be understood here, in particular, as a recess in an internal wall and/or an external wall or a recess as a region which is defined and delimited by any structural elements, such as for example wood, plastics, metal and the like, wherein the alcove may have any shape, preferably a rectangular shape. A "rear face" is intended to be understood, in particular, as a side of an outer wall, in particular of the freestanding household appliance, at least substantially facing away from the front face. A "lower face" of a freestanding household appliance is intended to be understood, in particular, as a side of an outer wall, in particular of the freestanding household appliance at least substantially facing a supporting surface in an installed position and in at least one operating state, a gravitational force being effective in the direction thereof. An "upper face" is intended to be understood, in particular, as a side of an outer wall, in particular of the freestanding household appliance at least substantially facing away from the lower face. The terms "top, "bottom" and "above" and "below" refer, in particular, to an installed position of the freestanding household appliance in at least one operating state. A "supporting surface" is intended to be understood here, in particular, as a surface, preferably a floor surface or kitchen unit bottom surface, on which a freestanding household appliance is positioned, wherein this household appliance is in contact with the surface, at least in one region of the surface, preferably by at least one supporting unit arranged on the freestanding household appliance, due to a gravitational force acting in a gravitational field, wherein the surface is oriented at least substantially transversely to a direction of the acting gravitational force, wherein the freestanding household appliance may advantageously adopt a stable position. "At least substantially" is intended to be understood in this context, in particular, that a deviation from a predetermined value, in particular, is less than 25%, preferably less than 10% and particularly preferably less than 5% of the predetermined value. An "outer wall" is intended to be understood here, in particular, as a surface of a freestanding household appliance which is oriented outwardly and which encloses an interior of the freestanding household appliance at least substantially in at least one operating state. An "interior" is intended to be understood, in particular, as a space which is delimited, in particular, by an inner surface of the machine housing which opposes a visible outer surface and which is at least partially not visible and namely, in particular, by at least two and preferably by at least three sides.

A "flow separating unit" is intended to be understood, in particular, as a device for separating at least two airflows, wherein the flow separating unit is configured as a physical barrier. "Integral" is intended to be understood here, in particular, as formed in one piece. Preferably, this one piece is produced from a single blank, a mass and/or a molded part, particularly preferably in an injection-molding method, in particular in a single-component and/or multi-component injection-molding method.

"Provided" is intended to be understood, in particular, as specifically designed and/or equipped. An object being provided for a specific function is intended to be understood, in particular, as the object fulfilling and/or carrying out this specific function in at least one use state and/or operating state.

By means of the embodiment according to the invention, in particular, it may be achieved that an advantageous ventilation and thus an advantageous dissipation of heat from heat-generating household appliance components, in particular a compressor unit and/or a condenser unit, is achieved. In particular, a targeted circulation of air around the freestanding household appliance is enabled. An efficient circulation of air is achieved by the prevention and/or diversion of air flows which flow back on themselves counter to a direction of the circulation of air by means of the flow unit. As a result, heated air produced in an immediate vicinity of the heat-generating and/or heat-dissipating freestanding household appliance components may be replaced by a cooler air, whereby an efficient cooling of the heat-generating and/or heat-dissipating freestanding household appliance components may be achieved. As a result, an efficient and rapid cooling may be carried out and thus the energy consumption for the cooling procedure and the costs associated therewith may be reduced and, as a result, in particular a cooling circuit system of the freestanding household appliance, for example of a combined fridge/freezer, may be achieved. Moreover, lower-powered and more efficient cooling components may be installed, which may lead to a reduced space requirement and lower constructional costs. Additionally, the length of the service life of the cooling components may be increased since the cooling is carried out more efficiently and thus reduced power may be required, for example by a reduced rotational speed of a fan. Moreover, noise development may be advantageously reduced due to quieter and lower-powered cooling components.

Advantageously, the household appliance apparatus has the outer wall, the flow separating unit extending at least substantially over the entire width thereof. A "width of the outer wall" is intended to be understood, in particular, in an installed position in at least one operating state, as an extent which is parallel relative to the lower face of the freestanding household appliance and which extends at least substantially along the rear face of the freestanding household appliance in a partial region of the outer wall, or alternatively an extent which is parallel to the rear face of the freestanding household appliance and which extends at least substantially along the lower face of the freestanding household appliance in a partial region of the outer wall in which the flow separating unit is mounted. As a result, an effective separation of the airflows may be achieved since the flow separating unit covers the entire width and at least substantially no throughflow points are present for an airflow. The extent of the flow separating unit may be interrupted by other structural elements of the freestanding household appliance, for example by a supporting unit. Preferably, the flow separating unit extends uninterrupted over the entire width of the outer wall.

It is further proposed that the outer wall is configured as a machine space outer wall. In particular, the machine space outer wall is part of the outer wall and is fastened thereto by means of a material, non-positive or positive connection, preferably a releasable connection. It is also conceivable that the machine space outer wall is fastened to a further unit arranged on the outer wall. In particular, the freestanding household appliance contains a machine space which is preferably arranged in a lower region of the rear face of the freestanding household appliance which is located closest to the lower face. The machine space outer wall at least partially encloses the machine space. As a result, an advantageous protective function of the machine space may be implemented, whereby machine space components are protected, in particular, from impacts, for example during an installation procedure and/or transportation procedure of the freestanding household appliance, and from the penetration of foreign bodies in the machine space, for example dirt, dust or small creatures. Preferably, the freestanding household appliance contains a fan unit which is arranged in the machine space. In particular, the freestanding household appliance has a compressor unit and a condenser unit which are arranged in the machine space. In particular, the machine space outer wall has at least one ventilation opening through which air is drawn in through the fan unit, wherein an advantageous airflow may be produced, the airflow flowing through the machine space and being able to cool this machine space. A "fan unit" is intended to be understood, in particular, as a unit which generates an airflow, in particular by electrical energy, and which preferably has a specifically integrally formed rotating fan blower wheel which draws in air on at least one side and ejects the air on at least one further side.

It is further proposed that the flow separating unit has at least one first separating portion and at least one second separating portion with a flexibility which is at least partially different from the first separating portion. As a result, the flow separating unit may be advantageously adapted in a flexible manner at a region in which a flow separation takes place. Preferably, the flow separating unit consists at least substantially of at least one plastics material. In particular, the flexibility may be achieved by different plastics materials and/or by the addition of plasticizing substances. The flow separating unit may, however, also comprise a combination of different materials. In particular, the flow separating unit may at least substantially consist of a thermoplastic elastomer or rubber. It is also conceivable that the flow separating unit is configured as an integral piece, in particular produced in an extrusion method. In particular, the first separating portion may be arranged below the second separating portion. Preferably, the first separating portion and the second separating portion are configured integrally.

In particular, it is proposed that the first separating portion is configured to be more flexible than the second separating portion. As a result, the second separating portion may provide stability to the flow separating unit and the first separating portion may be flexibly adapted to the region in which the flow separating unit is arranged. In particular, the first separating portion is at least partially in contact with the supporting surface of the freestanding household appliance and/or a region of the kitchen unit and/or a wall or a surface defining an alcove, wherein the alcove is provided to receive the household appliance, in particular with the kitchen unit, and to delimit a large part of the outer wall of the household appliance except for a region of the outer wall. Preferably, the second partial portion of the flow separating unit is in contact with the outer wall of the freestanding household appliance.

It is further proposed that when viewed in its longitudinal direction the first separating portion has a curved path, at least in some regions. Preferably, the path has a circular arc-shaped path. The path may also have a shape which is angled, curved or curved differently in a complex manner, in particular in the longitudinal direction of the first separating portion. A "longitudinal direction of the separating portion" is intended to be understood here, in particular, as an extent along a longest edge of a smallest rectangular parallelepiped which is positioned around the separating portion and which fully encloses the separating portion. As a result, a particularly advantageous sealing of a region, in particular of a gap between the outer wall and the supporting surface or a wall or a surface defining an alcove, may be achieved. In particular, an at least substantially concave side of the first separating portion may be at least partially oriented counter to a flow direction of an airflow to be separated and to be diverted from at least one further airflow. As a result, an efficient deflection of an airflow and thus a separation of the airflows may be advantageously carried out.

An advantageous, in particular effectively sealing design of the first separating portion may be implemented if this first separating portion is at least partially, preferably entirely, configured as a sealing lip. As a result, an advantageous sealing action may be achieved. The sealing lip may advantageously produce an efficient flow separation. The sealing lip may have a curve provided by a production process of the sealing lip. In particular, an additional curve may be produced in at least one mounted state, wherein an "additional curve" is intended to be understood here, in particular, as a deformation of the component occurring due to mechanical stress of the component, in which—in contrast to a unidirectional compression or expansion of the component—a curvature of the component is altered relative to a longitudinal direction.

The sealing action is produced by the sealing lip being in contact with a surface, in particular the supporting surface or a wall or a surface defining an alcove, wherein the sealing action is produced, in particular, from active forces due to a bending stress applied to the sealing lip.

In a further embodiment of the flow separating unit, it is proposed that the first separating portion is at least partially configured in the manner of a vertical slat blind. Preferably, the first separating portion is entirely configured as a vertical slat blind. As a result, a particularly variable adaptation of the first separating portion to the contact surface, in particular to the supporting surface or a wall or a surface defining an alcove, and thus a particularly effective seal and accordingly a particularly effective flow separation may be carried out. The vertical slat blind may at least partially consist of individual vertical slats which are not joined together, in particular overlapping vertical slats, which are at least substantially oriented transversely to the longitudinal direction of the first separating portion. The vertical slats are fastened in one of their regions to the first separating portion or to the second separating portion, and with a further region are in contact with a surface, in particular the supporting surface or a wall or a surface defining an alcove. In particular, the individual louvers may have a curved path.

Advantageously the second separating portion is provided to fasten the flow separating unit to the outer wall. As a result, the second separating portion may be fastened in an advantageously stable and simple manner. In particular, the second separating portion may be fastened to the machine space outer wall. Preferably, the second separating portion is directly fastened to the machine space outer wall or to a further region of the outer wall such that the flow separating unit is at least substantially arranged below the ventilation opening of the machine space outer wall. As a result, the flow may be separated. In this case, a first airflow is produced, wherein the air surrounding the freestanding household appliance, in particular located on the rear face of the freestanding household appliance, is drawn in at the ventilation opening of the machine space outer wall. As the air drawn in on the lower face of the freestanding household appliance flows in the direction of the front face by the fan unit, a second airflow is produced. Moreover, a third airflow is produced by the air flowing on the lower face toward the rear face of the freestanding household appliance, the third airflow flowing back on itself and being able to be diverted by the flow separating unit. The second separating portion connects the flow separating unit by a material and/or positive connection, preferably by a form-locking connection, to the outer wall, in particular to the machine space outer wall. Particularly preferably, the connection is configured as a releasable connection. As a result, the flow separating unit may be mounted and dismantled in a simple and time-saving manner, for example for cleaning and/or repair purposes.

It is further proposed that the second separating portion is at least partially, preferably entirely, configured as a U-shaped profile which is provided for receiving at least one part of the outer wall. As a result, an advantageously stable connection to the outer wall may be achieved. Moreover, as a result, a mounting and dismantling of the flow separating unit which is particularly easy to implement may be carried out. Preferably, the second separating portion is entirely configured as a U-shaped profile. The U-shaped profile of the second separating portion has a first flange and a second flange and a web which connects together the first and the second flange. The first and/or the second flange may have different heights. Moreover, the first and/or the second flange may have in each case a variable height in some regions along their longitudinal extent. A "longitudinal extent" of a unit is intended to be understood here, in particular, as a length of a longest edge of the smallest rectangular parallelepiped which is placed around the unit and which entirely encloses the unit. Preferably, the first and the second flange are of equal height. Advantageously, the second separating portion is of flexible configuration so that when the U-shaped profile of the second separating portion is bent apart, in particular for mounting purposes, a resilient deformation takes place, in particular when the first and the second flange are deflected from a respective resting position and a restoring force acts thereon.

It is further proposed that the second separating portion has at least one outer part and at least one inner part which is arranged on the outer part and which has a greater flexibility than the outer part. As a result, an advantageously stable connection to the outer wall may be achieved. The outer part of the second separating portion is provided to provide stability to the second separating portion. The inner part of the second separating portion, which in comparison with the outer part has a greater flexibility, ensures an advantageous slip-proof contact with the outer wall of the freestanding household appliance, in particular the machine space outer wall.

Advantageously, viewed in a longitudinal direction of the second separating portion, the inner part has at least in some regions a tooth geometry and is provided to fasten the flow separating unit to the outer wall by a clamped connection. As a result, advantageously the flow separating unit may be mounted and dismantled in a simple manner. Additionally, the risk of inadvertent release or slippage of the flow separating unit from a mounted position may be reduced. Moreover, the mounting may be carried out without alterations to the machine space outer wall and/or without additional mounting components. Preferably, the inner part of the second separating portion has the tooth geometry along the entire length of the second separating portion. The tooth geometry of the inner part enables, with the clamped connection, a particularly advantageous force transmission of the restoring force due to a deflection of the flange from its respective resting position, wherein the outer wall and, in particular, the machine space outer wall are clamped between the flanges of the second separating portion which is in the shape of a U-shaped profile. As a result, the tooth geometry enables an improved adhesion due to greater local static friction between the tooth geometry and the machine space outer wall.

Moreover, a freestanding household appliance which is provided for mounting in at least one alcove and which has at least one household appliance apparatus according to the invention is proposed.

Moreover, a system with a freestanding household appliance and with at least one kitchen unit which at least partially defines the alcove is proposed.

The household appliance apparatus is not intended in this case to be limited to the above-described use and embodiment. In particular, for fulfilling a function described herein the household appliance apparatus may have a number of individual elements, components and units which differs from that cited herein.

Further advantages are disclosed from the following description of the drawing. Exemplary embodiments of the invention are shown in the drawing. The drawing, the description and the claims contain numerous features in combination. The person skilled in the art will expediently consider the features individually and combine them to form further meaningful combinations.

DETAILED DESCRIPTION OF THE INVENTION

Figure 1:
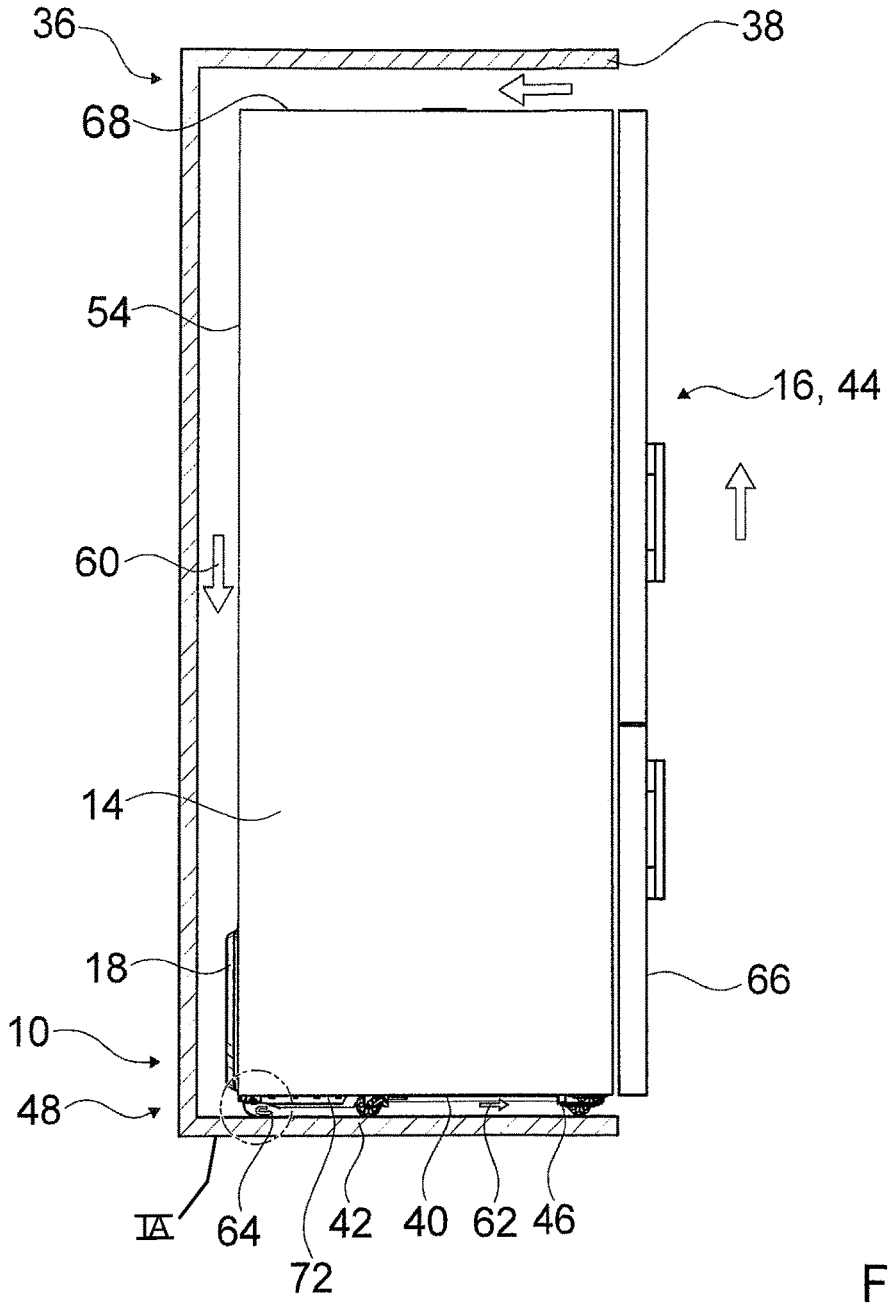
FIG. 1 is a diagrammatic, side view of a freestanding household appliance configured as a combined fridge/freezer with a household appliance apparatus in an arrangement in a kitchen unit.

Referring now to the figures of the drawings in detail and first, particularly to FIG. 1 thereof, there is shown a system, in particular a kitchen system, with a freestanding household appliance 16 in a kitchen unit 38. The kitchen unit 38 at least partially defines an alcove 36. The alcove 36 may be defined, in particular, by an internal wall or an external wall. The freestanding household appliance 16 is arranged in the kitchen unit 38 which is configured as an alcove 36. The freestanding household appliance 16 has a household appliance apparatus 10. The household appliance apparatus 10 has a flow separating unit 12. The flow separating unit 12 is provided for separating at least two airflows 60, 62, 64. The freestanding household appliance 16 is configured as a combined fridge/freezer 44.

The freestanding household appliance 16 is provided for mounting in the alcove 36. The combined fridge/freezer 44 is at least substantially arranged entirely in the alcove 36 which is defined by the kitchen unit 38. The combined fridge/freezer 44 has an outer wall 14. A lower face 40 of the freestanding household appliance 16 is in contact with a supporting surface 42 of the alcove 36, wherein the lower face 40 forms a part of the outer wall 14. A gap 46 is formed between the lower face 40 and the supporting surface 42.

The lower region of the combined fridge/freezer 44 has a machine space 48. In particular, a condenser unit, a compressor unit and a fan unit 50 are arranged in the machine space 48. The machine space 48 is delimited at the bottom by a compressor support rail 72 and to the rear by a machine space outer wall 18, wherein the compressor support rail 72 and the machine space outer wall 18 in each case are part of the outer wall 14 of the combined fridge/freezer 44.

Figure 2:
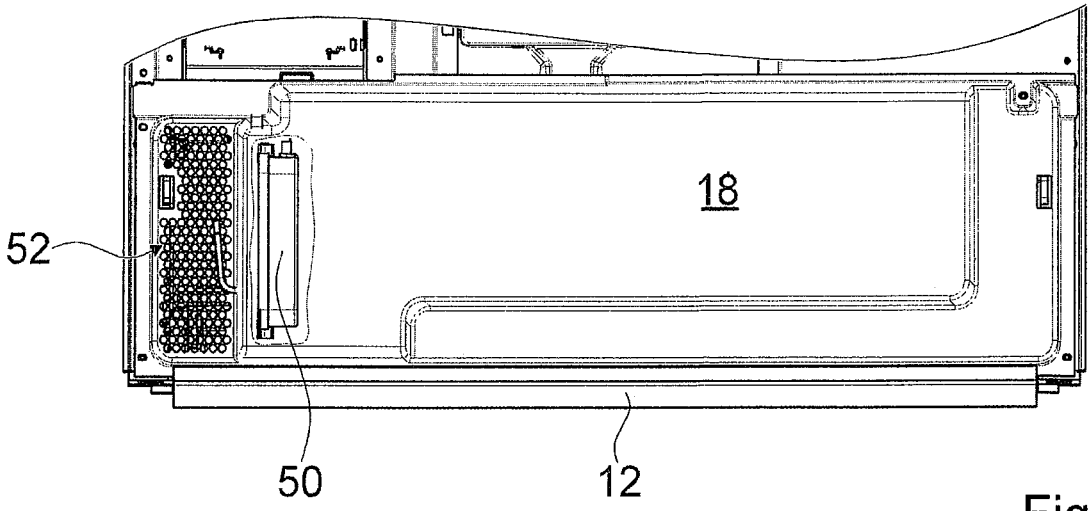
FIG. 2 is a perspective view of a lower rear face of the combined fridge/freezer with a machine space outer wall.

The machine space outer wall 18 has circular ventilation openings 52 (FIG. 2). The ventilation openings 52 may also be of slotted configuration. The ventilation openings 52 are located on one side of the machine space outer wall 18. It is also conceivable that the ventilation openings 52 are arranged on an upper face of the machine space outer wall 18. The flow separating unit 12 is arranged on the machine space outer wall 18 such that firstly it does not cover the ventilation openings 52 and secondly it is fastened below the ventilation openings 52 to the machine space outer wall 18. The fan unit 50 generates a vacuum in a region of the machine space 48 and as a result draws in air on a rear face 54 of the combined fridge/freezer 44 into the machine space 48.

The flow separating unit 12 is fastened in a lower region of the combined fridge/freezer 44 to the machine space outer wall 18 of the combined fridge/freezer 44. The flow separating unit 12 extends over the entire width of the lower face 40. The flow separating unit 12 covers the gap 46 produced between the lower face 40 and the supporting surface 42. The flow separating unit 12 at least substantially forms an air-impermeable barrier.

Figure 3:
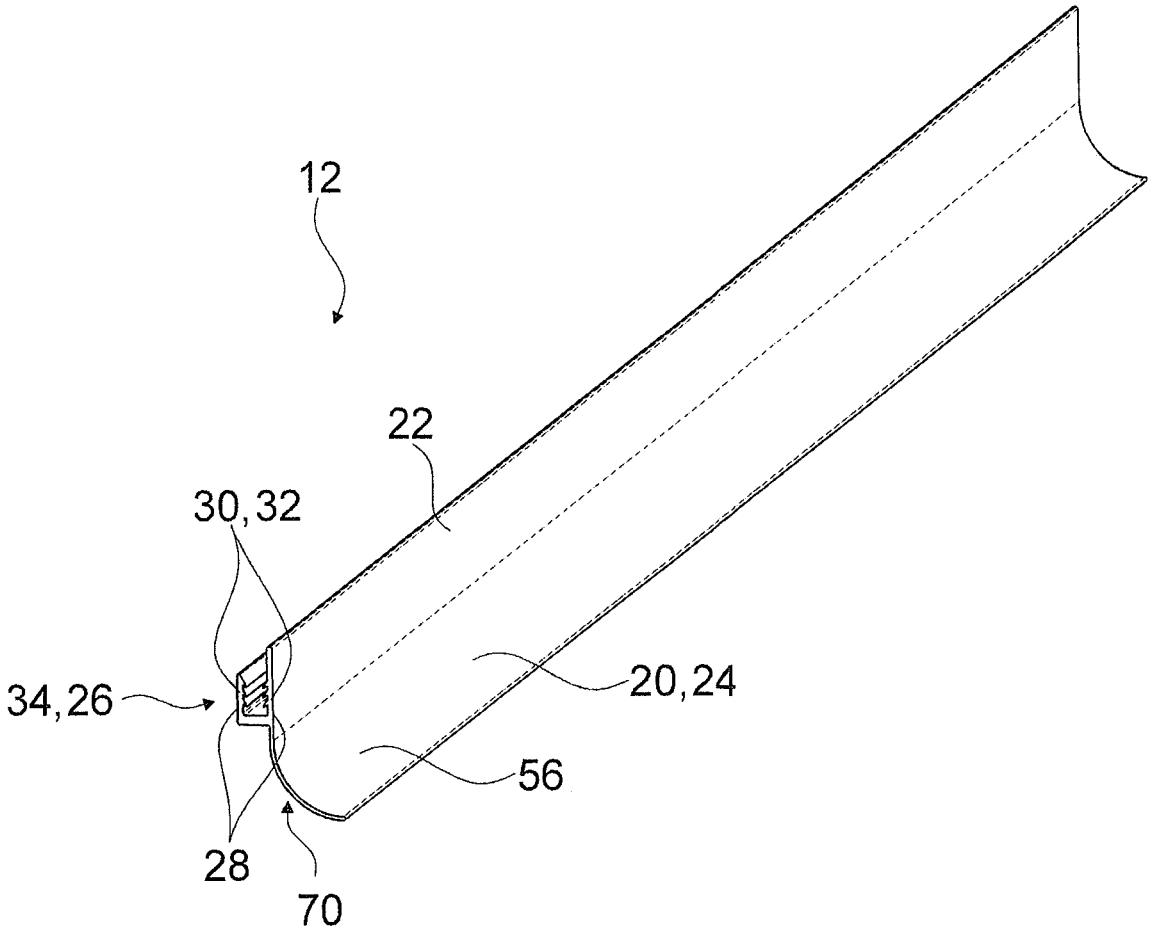
FIG. 3 is a perspective, side view of a flow separating unit as seen obliquely from above.

FIG. 3 shows the flow separating unit 12 in a perspective side view obliquely from above. The flow separating unit 12 has a first separating portion 20. The flow separating unit 12 has a second separating portion 22. The flow separating unit 12 is configured integrally.

The second separating portion 22 may have at least partially a flexibility which is different from the first separating portion 20. Preferably, the first separating portion 20 is configured to be more flexible than the second separating portion 22. The first and the second separating portion 20, 22 are formed from the same plastics material. The first and the second separating portion 20, 22 have a variable concentration of plasticizing components which determine the variable flexibility of the first and the second separating portion 20, 22. The flow separating unit 12 may also be configured at least partially from an elastomer and/or a rubber. It is possible that the flow separating unit 12 is able to be produced as an extruded profile in an extrusion method.

The flow separating unit 12 is fastened by the second separating portion 22 to the machine space outer wall 18. The second separating portion 22 is entirely configured as a U-shaped profile 26. It is also conceivable that the second separating portion 22 is formed only in some regions as a U-shaped profile 26. The U-shaped profile 26 receives the lower face of the machine space outer wall 18 between the flanges of the U-shaped profile 26. A clamped connection 34 produced thereby fixes the flow separating unit 12 to the machine space outer wall 18. To this end, the flow separating unit 12 is able to be pushed from the bottom onto a lower face of the machine space outer wall 18.

The second separating portion 22 has an outer part 28 and an inner part 30. The inner part 30 has a greater flexibility in comparison with the outer part 28. The inner part 30 is arranged on the outer part 28.

Viewed in a longitudinal direction of the second separating portion 22, the inner part 30 continuously has a tooth geometry 32. The individual teeth of the tooth geometry 32 are formed so as to be oriented counter to a mounting direction such that the flow separating unit 12 is mounted with a smaller expenditure of force than when the flow separating unit 12 is dismantled. When the flow separating unit 12 is mounted, the outer part 28 of the second separating portion 22 is elastically deformed and produces a contact pressure due to a restoring force. By means of the contact pressure a clamped connection 34 is produced between the flow separating unit 12 and the machine space outer wall 18. In this case, the inner part 30 and, in particular, the individual teeth of the tooth geometry 32 are deformed, which leads to a stable non-positive connection.

In a view in a longitudinal direction of the first separating portion 20 the first separating portion 20 has a curved path. The first separating portion 20 is curved such that an at least substantially concave side 56 of the first separating portion 20 faces in the direction of a front face 66 of the combined fridge/freezer 44. The first separating portion 20 is in contact with the supporting surface 42 along the entire longitudinal extent of the flow separating unit 12.

The first separating portion 20 is entirely configured as a sealing lip 24. Bending stress is produced by a curvature 70 of the first separating portion 20. The bending stress produces an additional contact pressure of the first separating portion 20 on the supporting surface 42 and thus an advantageous sealing action of the sealing lip 24. Due to the flexibility of the sealing lip 24 the curvature 70 of the sealing lip 24 may be configured to be of variable strength and of variable configuration, whereby the gap 46 may be partially sealed irrespective of the gap size.

Figure 4:
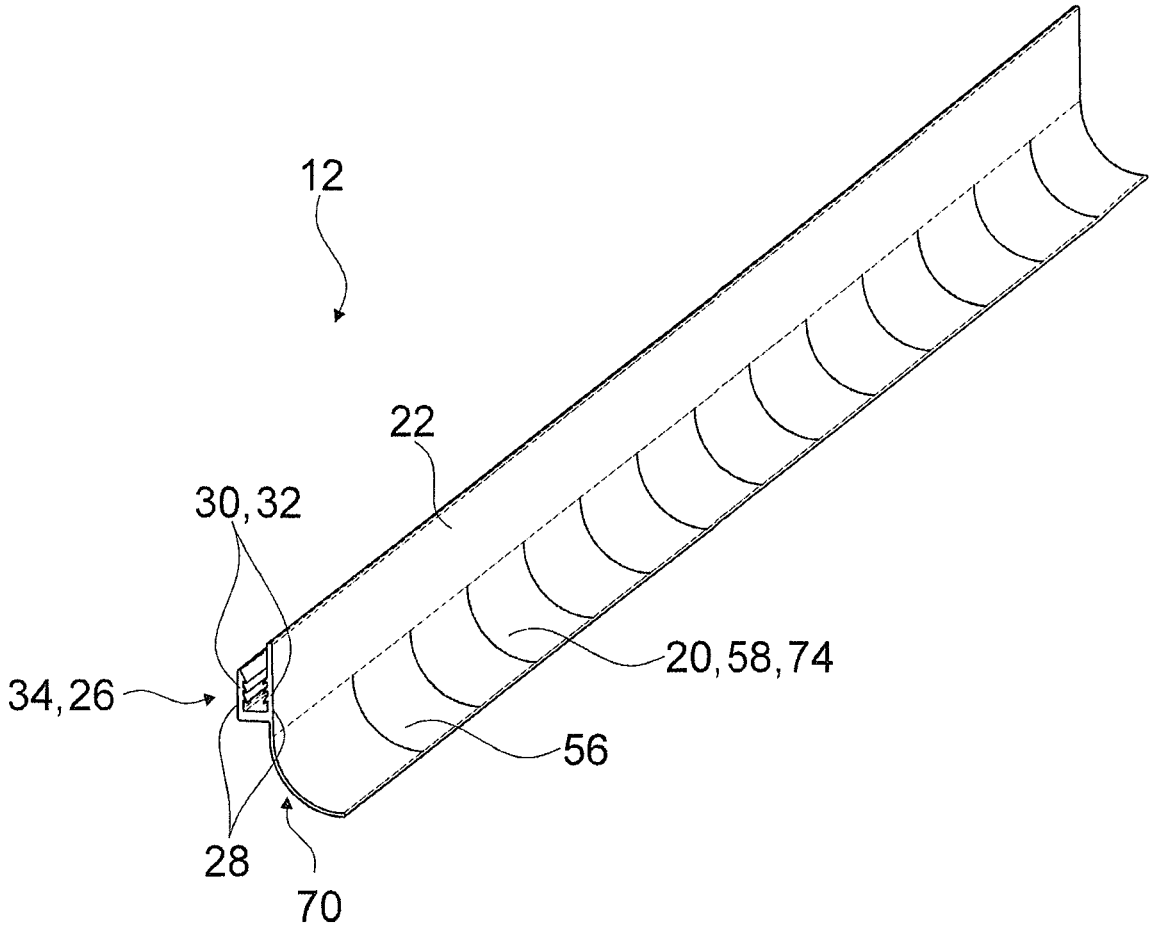
FIG. 4 is a perspective, side view of an alternative flow separating unit as seen obliquely from above.

It is also conceivable that the first separating portion 20 is configured as a vertical slat blind 58 (see FIG. 4). The vertical slat blind 58 has vertical slats 74. The individual vertical slats 74 of the vertical slat blind 58 have a similar sealing action as the sealing lip 24. The vertical slats 74 may have a curved path. The vertical slats 74 may overlap one another.

Figure 1A:
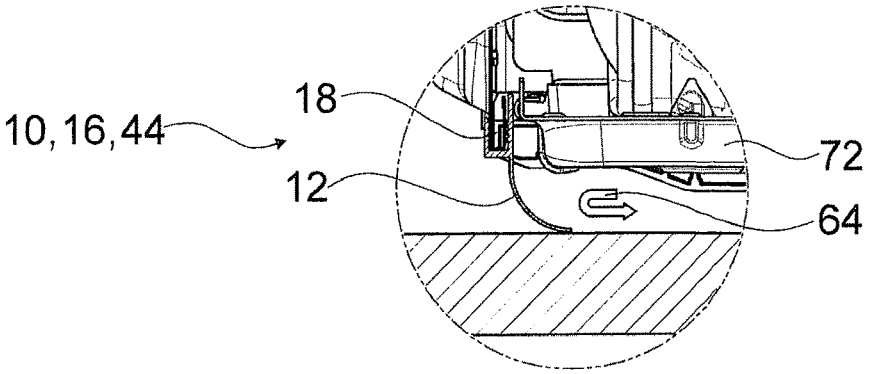
FIG. 1A is an enlarged view of a longitudinal section of area IA shown in FIG. 1 of a rear corner of the combined fridge/freezer and the flow separating unit fastened to the outer wall.

As may be seen in FIGS. 1 and 1A, an air circuit is produced by a circulation of the air by means of the fan unit 50 around the combined fridge/freezer 44. The fan unit 50 draws in the air through the ventilation openings 52 of the machine space outer wall 18 (see FIG. 2), whereby a first airflow 60 is produced. The drawn-in air is provided to dissipate heat from heat-generating and/or heat-dissipating components of the combined fridge/freezer 44 and to cool the components thereby.

The fan unit 50 conveys the drawn-in air from the machine space 48 on the lower face 40 of the combined fridge/freezer 44 through the gap 46 in the direction of a front face 66 of the combined fridge/freezer 44. As a result, a second airflow 62 is produced, the second airflow subsequently passing on the front face 66 of the combined fridge/freezer 44 via an upper face 68 of the combined fridge/freezer 44 to the rear face 54 of the combined fridge/freezer 44.

A third airflow 64 flows as a portion of the air which is expelled by the fan unit 50 from the machine space 48 and which is oriented at least substantially toward the rear face 54, the third airflow flowing back on itself. The flow separating unit 12 at least substantially entirely seals the region between the lower face 40 and the supporting surface 42 relative to a region on the rear face 54.

The flow separating unit 12 diverts the third airflow 64 by the advantageous curvature 70 of the flow separating unit 12 which in this case additionally functions as a barrier. Thus the first airflow 60 and the third airflow 64 are separated at least substantially from one another by the flow separating unit 12. As a result, a heat-dissipating cooling air circuit is produced around the combined fridge/freezer 44. By means of the flow separating unit 12, heat is prevented from being stored in the machine space 48 and in the regions adjacent thereto. As a result, an uninterrupted operation of a refrigeration circuit system of the combined fridge/freezer 44 is possible.

REFERENCE CHARACTERS

10 Household appliance apparatus
12 Flow separating unit
14 Outer wall
16 Freestanding household appliance
18 Machine space outer wall
20 Separating portion
22 Separating portion
24 Sealing lip
26 U-shaped profile
28 Outer part
30 Inner part
32 Tooth geometry
34 Clamped connection
36 Alcove
38 Kitchen unit
40 Lower face
42 Supporting surface
44 Combined fridge/freezer
46 Gap
48 Machine space
50 Fan unit
52 Ventilation opening
54 Rear face
56 Side
58 Vertical slat blind
60 Airflow
62 Airflow
64 Airflow
66 Front face
68 Upper face
70 Curvature
72 Compressor support rail
74 Vertical slat

The invention claimed is:

1. A household appliance apparatus, comprising:

a freestanding appliance having an outer wall;

a support for resting against a supporting surface and supporting said freestanding appliance on the supporting surface and spacing said outer wall from the supporting surface at a gap;

at least one flow separating unit provided for separating at least two airflows, said at least one flow separating unit configured for mounting on said outer wall, said at least one flow separating unit having at least one first separating portion and at least one second separating portion, said at least one first separating portion being configured as a sealing lip, said at least one first separating portion constructed for being in contact with at least one of the supporting surface or a surface defining an alcove.

2. The household appliance apparatus according to claim 1, wherein said at least one first separating portion is at least partially configured as a vertical slat blind.

3. The household appliance apparatus according to claim 1, wherein said at least one flow separating unit extending at least substantially over an entire width of said outer wall.

4. The household appliance apparatus according to claim 3, wherein the outer wall is configured as a machine space outer wall.

5. The household appliance apparatus according to claim 1, wherein said at least one second separating portion has a flexibility which is different from said at least one first separating portion.

6. The household appliance apparatus according to claim 5, wherein said at least one first separating portion is configured to be more flexible than said at least one second separating portion.

7. The household appliance apparatus according to claim 5, wherein when viewed in a longitudinal direction said at least one first separating portion has a curved path, at least in some regions.

8. The household appliance apparatus according to claim 5, wherein said at least one second separating portion is provided to fasten said at least one flow separating unit to the outer wall.

9. The household appliance apparatus according to claim 8, wherein said at least one second separating portion is at least partially configured as a U-shaped profile which is provided for receiving at least one part of the outer wall.

10. The household appliance apparatus according to claim 9, wherein said at least one second separating portion has at least one outer part and at least one inner part which is disposed on said outer part and which has a greater flexibility than said outer part.

11. The household appliance apparatus according to claim 10, wherein when viewed in a longitudinal direction of said at least one second separating portion, said inner part has at least in some regions a tooth geometry and is provided to fasten said at least one flow separating unit to the outer wall by means of a clamped connection.

12. A system, comprising:

a freestanding household appliance containing an outer wall having a width;

at least one kitchen unit defining an alcove having a surface; and a household appliance apparatus having at least one flow separating unit provided for separating at least two airflows, said at least one flow separating unit mounted on said outer wall, said at least one flow separating unit having at least a separating portion being configured as a sealing lip, said separating portion constructed for being in contact with at least one of a supporting surface of the freestanding household appliance substantially over an entirety of said width of said outer wall or said surface of said alcove over substantially an entirety of said width of said outer wall.

* * * * *